US005849452A

United States Patent [19]

Takenaka et al.

[11] Patent Number: 5,849,452

[45] Date of Patent: Dec. 15, 1998

[54] DEVELOPING METHOD USING AN OSCILLATED ELECTRIC FIELD AND INCLUDING A SPECIFIED TONER AND CARRIER

[75] Inventors: Koichi Takenaka, Itami; Makoto Kobayashi, Kobe; Tomoharu Nishikawa, Hirakata; Hideaki Yasunaga, Sakai, all of Japan

[73] Assignee: Minolta Co., Ltd., Osaka, Japan

[21] Appl. No.: 816,687

[22] Filed: Mar. 13, 1997

[30] Foreign Application Priority Data

Mar. 14, 1996 [JP] Japan ..... 8-087644

[51] Int. Cl.[6] ..... G03G 13/09

[52] U.S. Cl. ..... 430/122; 430/106.6

[58] Field of Search ..... 430/106.6, 108, 430/122

[56] References Cited

U.S. PATENT DOCUMENTS

| | | | |
|---|---|---|---|
| 4,447,517 | 5/1984 | Yuge et al. | 430/122 |
| 4,557,992 | 12/1985 | Haneda et al. | 430/122 |
| 4,600,675 | 7/1986 | Iwasa et al. | 430/106.6 |
| 4,675,267 | 6/1987 | Haneda et al. | 430/102 |
| 4,746,589 | 5/1988 | Haneda et al. | 430/120 |
| 4,797,335 | 1/1989 | Hiratsuka et al. | 430/35 |
| 4,847,176 | 7/1989 | Sano et al. | 430/106.6 |
| 4,885,222 | 12/1989 | Kaneko et al. | 430/102 |
| 4,968,573 | 11/1990 | Kaneko et al. | 430/106.6 |
| 5,318,873 | 6/1994 | Kawamura et al. | 430/122 |
| 5,346,791 | 9/1994 | Ozawa et al. | 430/106.6 |
| 5,472,817 | 12/1995 | Shibano et al. | 430/106.6 |
| 5,667,924 | 9/1997 | Ziolo | 430/122 |

FOREIGN PATENT DOCUMENTS

| | | |
|---|---|---|
| 61-32858 | 2/1986 | Japan . |
| 62-182760 | 8/1987 | Japan . |
| 5-323681 | 12/1993 | Japan . |

*Primary Examiner*—John Goodrow

[57] ABSTRACT

A developing method for developing electrostatic latent images comprising:

(a) forming a thin layer of a developer comprising a toner and a carrier on a developer transporting member having a magnet therein by contacting the developer with a developer regulating member, wherein said carrier has a volume-average particle size of 10 to 50 $\mu$m and a residual magnetization of 10 emu/g or less, and wherein an amount of said thin layer of developer is in the range of 0.7 to 10.0 mg/cm$^2$;

(b) transporting the thin layer to a developing region in which the developer transporting member confronts an image bearing member; and (c) supplying the toner contained in the developer from the developer transporting member to the image bearing member with applying an oscillated electric field on the developing region.

20 Claims, 1 Drawing Sheet

DEVELOPING METHOD USING AN OSCILLATED ELECTRIC FIELD AND INCLUDING A SPECIFIED TONER AND CARRIER

BACKGROUND OF THE INVENTION

1. Field of the Invention

The present invention relates to a developing method for use in image forming apparatuses such as copying machines, printers and the like which supplies toner to an electrostatic latent image formed on a latent image bearing member to develop the image, and specifically relates to a developing method wherein a developer including a toner and a carrier is transported to a developing region opposite an image bearing member by a developer transporting member, and the toner contained in the developer is supplied from the developer transporting member to the image bearing member with applying an oscillated electric field on the developing region to accomplish development of the latent image.

2. Description of the Related Art

In conventional image forming apparatuses such as copying machines, printers and the like, there are various well known developing methods for supplying toner to an electrostatic latent image formed on an image bearing member to develop the latent image. Representative of these well known developing methods is the widely known developing method wherein a developer containing a toner and a carrier is supplied to a developer transporting member such as a developing sleeve or the like, the developer is transported to the image bearing member side of the developer transporting member in a magnetic brush state by the developer transporting member, the amount of developer on the surface of the developer transporting member is regulated by a regulating member, and thereafter the developer on the surface of the developer transporting member arrives at a developing region opposite an image bearing member and is brought into contact with the surface of the image bearing member at the developing region while in a magnetic brush state, and the toner in the developer is supplied from the developer transporting member to the latent image region so as to develop the latent image.

This method is disadvantageous, however, insofar as when developer in a magnetic brush state comes into contact with the image bearing member and develops the latent image, the toner on the surface of the image bearing member is swept by the magnetic brush formed on the surface of the developer transporting member, thereby disturbing the toner image formed on the surface of the image bearing member. Particularly when accomplishing multi-color developing by sequentially supplying toners of a plurality of colors to an image bearing member, the image formed by the color toner first supplied to the image bearing member is disturbed by contact with the magnetic brush when toner of a subsequent color is supplied, such that the toners of different colors become arbitrarily mixed and multi-color images having true color fidelity cannot be obtained.

Disruption of a toner image formed on the surface of an image bearing member when developing by contacting of a developer in a magnetic brush state with the image bearing member may also be caused by an increase in the magnetic force of the carrier in the developer, hardening of the magnetic brush, and so-called counter charging produced by a residual carrier charge when the toner in the developer is supplied to the image bearing member.

Therefore, it has been proposed in the conventional art that a carrier having a low magnetic force be used in the developer, and the tip of the magnetic brush which contacts the image bearing member should be softened so as to suppress disruption of the toner image through contact with the magnetic brush.

When a carrier having a low magnetic force is used, however, a disadvantage arises insofar as the binding power of the carrier on the developer transporting member is reduced, such that carrier separates from the developer transporting member and readily adheres to the image bearing member. The problem of excessive carrier adhering to the image bearing member occurs particularly when developing images such as high frequency images as in ladder patterns, and images such as kanji patterns (Chinese characters) having many lines or dots as input images.

When carrier adheres to the image bearing member, the carrier is transferred to the transfer sheet along with the toner image so as to cause non-printing spots in the formed image, and the adhered carrier may damage the image bearing member, and cause streak-like noise and spot-like noise in the formed image.

In recent years, developing methods have been proposed such as those disclosed in Japanese Unexamined Patent Application Nos. SHO 61-32858 and 62-182760 wherein a two-component developer composed of toner and a carrier is transported to a developing region opposite an image bearing member by a developer transporting member, and the toner contained in the developer is supplied from the developer transporting member to the image bearing member while a state of non-contact is maintained between the developer and the image bearing member with applying an oscillated electric field on the developing region so as to prevent a toner image formed on the surface of the image bearing member from being disturbed by the magnetic brush of the developer in the manner previously described.

However, even when developing is accomplished by supplying toner contained in a developer to an image bearing member while the developer is in a state of non-contact with the image bearing member with applying an oscillated electric field on the developing region, when the toner in the developer is supplied to the image bearing member, a counter charge still remains on the carrier and produces the problem of carrier adhesion on the image bearing member.

In order to suppress the aforementioned carrier adhesion on the image bearing member, Japanese Unexamined Patent Application No. HEI 5-323681 discloses a method wherein a large amount of developer is transported to the image bearing member by the developer transporting member to reduce the consumption rate of toner in the developer.

On the other hand, when the amount of developer transported to the image bearing member by the developer transporting member is increased and developing is accomplished by supplying toner contained in the developer to the image bearing member with applying an oscillated electric field on the developing region as previously mentioned, there is an increase in the amount of toner which becomes airborne and is not supplied to the image bearing member, thus causing fog in the formed image, and the dispersed toner causes soiling within the apparatus such as a copying machine.

When there is an increase in the amount of developer transported to the image bearing member by the developer transporting member, most of the charged toner in the developer is not used for developing, thereby adversely affecting the developing efficiency, most of the charged toner, as retained by the magnetic carrier on the developer transporting member, is returned to the interior of the developing device, where the magnetic carrier together with the charged toner particles are not sufficiently agitated and mixed with replenished toner particles so that the replenished toner fail to be fully charged.

SUMMARY OF THE INVENTION

An object of the present invention is to eliminate the previously described disadvantages arising when developing is accomplished by transporting developer containing toner and carrier to a developing region opposite an image bearing member via a developer transporting member, and in the developing region supplying toner in the developer from the developer transporting member to an image bearing member.

A further object of the present invention is to minimize disturbance of the toner image formed on an image bearing member when developing is accomplished by supplying toner in a developer from a developer transporting member to an image bearing member in a developing region and a magnetic brush formed of developer on the developer transporting member sweeps a toner image already formed on the image bearing member, minimize undeveloped spots on a formed image produced by the carrier, minimize damage to the image bearing member by adhered carrier, and minimize streak-like noise and spot-like noise in formed images, and stably produce excellent images without fogging of formed images or inadequate toner charging when large amounts of developer are transported to a developing region opposite an image bearing member.

These objects of the present invention are achieved by using a carrier having a residual magnetization of 10 emu/g or less in a developing method which accomplishes developing by transporting a developer containing a toner and a carrier to a developing region opposite an image bearing member while maintained in a thin layer state on a developer transporting member, and supplying the toner contained in the developer from the developer transporting member to the image bearing member with applying an oscillated electric field on the developing region.

The developing method of the present invention provides that when developing is accomplished by transporting a developer containing a toner and a carrier to a developing region opposite an image bearing member while maintained in a thin layer state on a developer transporting member and the toner in the developer is supplied to the image bearing member with applying an oscillated electric field on the developing region, the migration of residual charge to the carrier in the developer is smoothly accomplished, making difficult for the carrier to adhere to the image bearing member and reducing the amount of toner which is subject to airborne dispersion and not supplied to the image bearing member. Furthermore, the developing method of the present invention improves developing efficiency by reducing the amount of charged toner which is not used for developing and returned to the mixing area within the developing device, and improves the mixing characteristics (charging characteristics) of the fresh replenishment toner (uncharged toner).

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
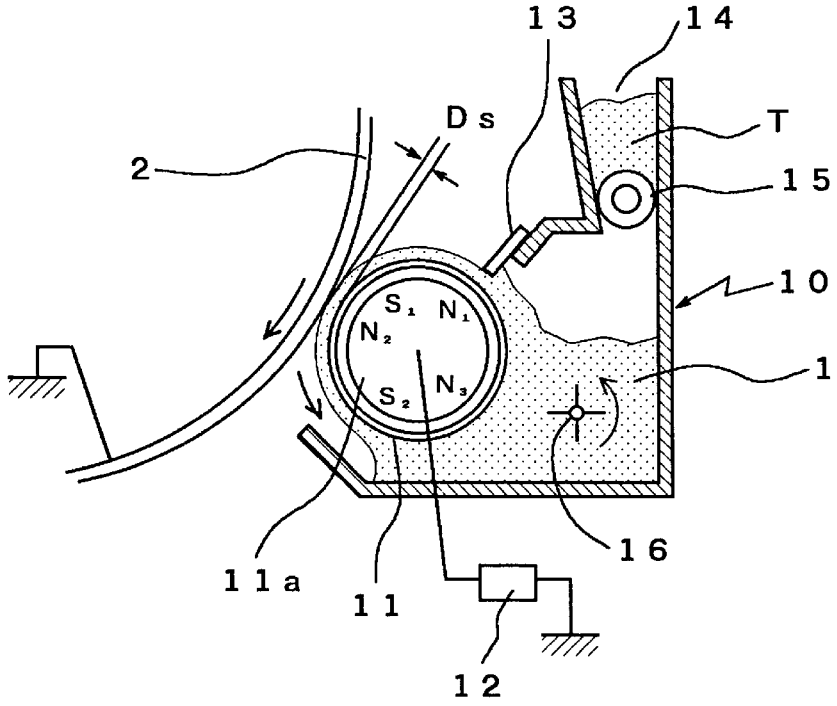
FIG. 1 briefly shows an example of a developing device using the developing method of the present invention.

The present invention accomplishes development by transporting developer containing a toner and a carrier to a developing region opposite an image bearing member while maintained in a thin layer state on a developer transporting member, and supplying toner in the developer from the developer transporting member to the image bearing member with applying an oscillated electric field on the developing region. The carrier used in this developing method is a carrier having a residual magnetization of 10 emu/g or less.

The carrier used has a residual magnetization of 10 emu/g or less. When using a carrier having a higher residual magnetization, the binding power of autologous carrier particles is strengthened in the mixing area within the developing device which mixes the toner and carrier, such that the toner and carrier are not adequately mixed nor the toner adequately charged, thereby causing fog in the formed images, developer flow characteristics are reduced causing polarization in the developer, it becomes difficult to form a uniform thin layer of developer on the surface of the developer transporting member, and irregular density occurs in the formed images. It is desirable to use carrier having a residual magnetization in the range of 3 to 10 emu/g, and preferably 3 to 8 emu/g.

When too small an amount of developer is transported to the developing region by the developer transporting member, insufficient toner is supplied to the image bearing member, and the produced images have inadequate image density. Therefore, the amount of developer transported to the developing region by the developer transporting member is desirably in the range of 0.7 to 10.0 mg/cm$^2$, and preferably 0.8 to 7.5 mg/cm$^2$, and more preferably 1 to 5 mg/cm$^2$.

When the carrier saturation magnetization is low, the carrier does not magnetically bind to the developer transporting member and the carrier readily adheres to the image bearing member. When the carrier saturation magnetization is too high, the carrier on the developer transporting member is particularly flocculated, thereby coarsening the density of the magnetic brush of developer and making it difficult to form a uniform thin layer of developer on the developer transporting member, and leading to irregular density of the formed image and reduced reproducibility of halftone images and high resolution images. Therefore, the carrier used will desirably have a saturation magnetization in the range of 30 to 80 emu/g, and preferably 35 to 65 emu/g, and more preferably 40 to 60 emu/g.

When the true specific gravity of the carrier is low, the mixing and transporting characteristics of the carrier are reduced such that the toner cannot be adequately charged, and the carrier adheres to the image bearing member because the magnetic binding of the carrier to the developer transporting member is insufficient. When the true specific gravity of the carrier is too high, the carrier saturation magnetization increases, so as to make it difficult to form a uniform thin layer of developer on the developer transporting member.

Therefore, it is desirable that the true specific gravity of the carrier is in the range of 1.5 to 4.0 g/cc, and preferably 2.0 to 3.5 g/cc.

When the aerated apparent specific gravity of the carrier is too low, the carrier flow characteristics are adversely affected such that the carrier cannot adequately mix with the toner, which leads to insufficient charging of the toner and fog in the formed image. When the aerated apparent specific gravity of the carrier is too high, the carrier flowability becomes excessive, such that the carrier cannot adequately hold the toner, which leads to insufficient charging of the toner and fog in the formed image. Therefore, an aerated apparent specific gravity of the carrier is desirably in the range of 0.5 to 2.0 g/cc, and preferably 0.8 to 1.3 g/cc.

When the volume-average particle size of the carrier is too small, there is concern that the carrier will not adequately bind to the developer transporting member and may adhere to the image bearing member. On the other hand, when the volume-average particle size of the carrier is too large, there is a coarsening of the density of the magnetic brush of developer on the developer transporting member, such that a uniform thin layer of developer cannot be formed on the developer transporting member, and thereby leading to concern of irregular density in the formed image, and reduced reproducibility of halftone images and high resolution images. Therefore, it is desirable that the volume-average particle size of the carrier is in a range of 10 to 50 $\mu$m, and preferably 20 to 45 $\mu$m, and more preferably 25 to 40 $\mu$m.

When the carrier has a broad particle size distribution, there is concern the proportion of large particles or small particles will increase and cause a reduction in flowability, inadequate toner charging, and carrier adhesion on the image bearing member. Therefore, when the volume-average particle size of the carrier is designated X, and the variance of the particle size distribution of the carrier is designated $o^2$, it is desirable to use a carrier satisfying the condition $X^2/o^2 \geqq 9.0$, and preferably satisfies the condition $X^2/o^2 \geqq 10.0$. Particularly when using a small particle toner having a volume-average particle size of 4 to 9 $\mu$m, it is desirable to use a carrier which satisfies the condition $X^2/o^2 \geqq 10.0$, and preferably satisfies the condition $X^2/o^2 \geqq 10.5$.

When the carrier intrinsic resistance value is reduced and the dynamic current value is increased, the amount of carrier charge is reduced and the toner cannot be sufficiently charged, leading to concern that carrier will readily adhere to the image bearing member when the toner is supplied from the developer transporting member to the image bearing member with applying the oscillated electric field as previously described. On the other hand, when the intrinsic resistance value of the carrier is increased and the dynamic current value is reduced too much, the amount of initial charge is too high and when developing an electrostatic latent image formed on an image bearing member, lines of electric force circumscribe the edge portions of the latent image thereby intensifying the electric field at the edge portions and causing stronger development of the edge portions. Therefore, it is desirable that the carrier have an intrinsic resistance in the range of $1\times10^9$ to $1\times10^{15}$ Ω·cm, and preferably $1\times10^{10}$ to $1\times10^{14}$ Ω·cm, and a dynamic current value in the range of 5 to 50 nA, and preferably 15 to 45 nA.

When using a binder type carrier wherein magnetic powder is dispersed in a binder resin, it is desirable that the magnetic powder has a residual magnetization in the range of 15 emu/g or less, and preferably 10 emu/g or less, and saturation magnetization of 30 to 100 emu/g, and it is further desirable that the amount of added magnetic powder is in the range of 150 to 500 parts-by-weight, and preferably 250 to 400 parts-by-weight relative to 100 parts-by-weight of binder resin.

In a developer produced by mixing toner and carrier as described above, when the weight ratio of toner in the developer is too low, adequate image density cannot be obtained and toner is excessively charged and producing an excessive amount of charge, such that adequate development cannot be accomplished. On the other hand, when the toner weight ratio is too high, the toner is not adequately charged by the carrier, and fog occurs in the formed image. Therefore, it is desirable that the toner weight ratio in the aforementioned developer is in the range of 8 to 20 percent-by-weight.

When development is accomplished in a developing region with applying an oscillated electric field between an image bearing member and a developer transporting member, and this oscillated electric field is weakened, there is concern the migration of charge to the carrier after toner discharge will be adversely affected, causing a counter charge to remain on the carrier which may readily lead to carrier adhesion on the image bearing member. On the other hand, when this oscillating electric field is too strong, leaks may easily occur between the developer transporting member and the image bearing member. Therefore, if the space between the developer transporting member and the image bearing member in the developing region is designated Ds, and the peak-to-peak value of the applied AC voltage is designated $V_{p\text{-}p}$, it is desirable that the oscillating field ($V_{p\text{-}p}$/Ds) be such that the following relationship obtains.

$$3.5\ \text{kV/mm} \leqq V_{p\text{-}p}/Ds \leqq 5.5\ \text{kV/mm}$$

In the developing method as described above, when developer containing toner and carrier is supplied to a developing region opposite an image bearing member by a developer transporting member, the developer can be delivered to the developing region in the state of a uniform thin layer on the surface of the developer transporting member, and when the toner in the developer is supplied from the developer transporting member to the image bearing member with applying an oscillated electric field in the developing region to accomplish development, image having fine detail are stably produced without fog in the formed image or carrier adhesion on the image bearing member which produces streak-like and sport-like noise in the formed image.

The developing method of the present invention is described hereinafter by way of specific examples with reference to the accompanying drawings.

An example of a developing device using the developing method of the present invention is shown in FIG. 1.

Developing device 10 internally accommodates a developer 1 including a toner T and a carrier, and a cylindrical developing sleeve 11 with a built-in magnet roller 11*a* provided on the interior side thereof which has a plurality of magnetic poles N1, S1, N2, S2, N3 which is used as a developer transporting member 11 for transporting developer 1, and developing sleeve 11 is arranged so as to be rotatable and confronts a photosensitive member 2 acting as an image bearing member in a developing region with a suitable distance Ds therebetween.

Developing sleeve 11 is rotated in the opposite direction to the rotation direction of photosensitive member 2, i.e., developing sleeve 11 is rotated so as to move in the same direction as the photosensitive member 2 in the developing region wherein developing sleeve 11 and photosensitive member 2 confront one another, and the developer 1 accommodated within developing device 10 is transported to photosensitive member 2 in a magnetic brush state by means of the magnetic force exerted by magnetic sleeve 11*a* in conjunction with the rotation of the developing sleeve 11.

A developing bias power unit 12 is connected to developing sleeve 11, and supplies a developing bias voltage including an alternating current (AC) voltage, or a direct current (DC) voltage overlaid on an alternating current (AC) voltage so as to produce an oscillating electric field in the developing region.

A magnetic blade 13 is provided at a predetermined spacing from developing sleeve 11 at a position opposite the magnetic pole N1 of magnetic roller 11*a* on the upstream side of the developing region at which developing sleeve 11 confronts photosensitive member 2 in the direction of developer 1 transport, the magnetic blade 13 being provided to regulate the amount of developer 1 on the surface of developing sleeve 11.

In developing device 10, a toner container 14 to accommodate toner T is provided at the top of developing device 10. When the concentration of toner in developer 1 within developing device 10 is reduced as a result of supplying the toner T in developer 1 from developing sleeve 11 to photosensitive member 2 to accomplish development, a toner supply roller 15 provided at the bottom of toner container 14 is rotated, such that toner T accommodated within the toner container 14 is supplied to the developer 1 in developing device 10, and the supplied toner T is mixed with developer 1 by a mixing member 16 provided within developing device 10, then supplied to developing sleeve 11.

In developing device 10, the amount of developer 1 on the surface of developing sleeve 11 is regulated by magnetic blade 13 provided on the upstream side in the direction of developer 1 transport from the developing region wherein developing sleeve 11 confronts photosensitive member 2, developer 1 is transported in a thin layer state on the surface of developing sleeve 11 to the developing region opposite the photosensitive member 2, a developing bias voltage is applied from developing bias power unit 12 to produce an oscillating electric field in the developing region, such that the toner T in the developer 1 transported on developing sleeve 11 is supplied to an electrostatic latent image area on the surface of photosensitive member 2 to accomplish development of said latent image.

Experiments were conducted using various types of carrier in developer 1 used in developing device 10 to clarify which carriers satisfy the conditions of the present invention.

Seven types of carriers labeled carrier A through carrier G were manufactured in the manner described below.

Production of Carrier A

The materials below were used in the stated ratios, which included 100 parts-by-weight (hereinafter abbreviated as "pbw") polyester resin (Toughton NE-1110; made by Kao Co., Ltd.), 250 pbw magnetic powder having a residual magnetization of 3.2 emu/g and saturation magnetization of 65.3 emu/g, 2 pbw carbon black (Kethchen Black; made by Lion Yushi K.K.), and 1.5 pbw silica (#200; made by Nippon Aerosil K.K.).

After these materials were thoroughly mixed in a Henschel mixer, the mixture was fusion kneaded at 180° C. in a vented type dual-shaft extrusion kneader, cooled, and coarsely pulverized using a feather mill, finely pulverized using a jet mill (model IDS-2), and subsequently classified by forced air, and subjected to a heat treatment at 300° C. using a Surfusing System (model SFS-1; made by Nippon Pneumatic Industries Co., Ltd.) to obtain carrier A having a volume-average particle size of about 32 μm.

Production of Carrier B

Carrier B was produced in the same manner as carrier A with the exception that the materials below were used in the stated ratios, which included 100 pbw polyester resin (Toughton NE-1110; made by Kao Co., Ltd.), 350 pbw magnetic powder having a residual magnetization of 8.5 emu/g and saturation magnetization of 70.2 emu/g, 2 pbw carbon black (Kethchen Black; made by Lion Yushi K.K.), and 1.5 pbw silica (#200; made by Nippon Aerosil K.K.), to obtain carrier B having a volume-average particle size of about 29 μm.

Production of Carrier C

Carrier C was produced in the same manner as carrier A with the exception that the materials below were used in the stated ratios, which included 100 pbw polyester resin (Toughton NE-1110; made by Kao Co., Ltd.), 400 pbw magnetic powder having a residual magnetization of 4.3 emu/g and saturation magnetization of 72.7 emu/g, 2 pbw carbon black (Kethchen Black EC; made by Lion Yushi K.K.), and 1.5 pbw silica (#200; Nippon Aerosil K.K.), to obtain carrier C having a volume-average particle size of about 31 μm.

Production of Carrier D

Carrier D was produced in the same manner as carrier A with the exception that the materials below were used in the stated ratios, which included 100 pbw polyester resin (Toughton NE-1110; made by Kao Co., Ltd.), 250 pbw magnetic powder having a residual magnetization of 19.4 emu/g and saturation magnetization of 66.3 emu/g, 2 pbw carbon black (Kethchen Black; made by Lion Yushi K.K.), and 1.5 pbw silica (#200; made by Nippon Aerosil K.K.), to obtain carrier D having a volume-average particle size of about 30 μm.

Production of Carrier E

Carrier E was produced in the same manner as carrier A with the exception that the materials below were used in the stated ratios, which included 100 pbw polyester resin (Toughton NE-1110; made by Kao Co., Ltd.), 700 pbw magnetic powder having a residual magnetization of 19.4 emu/g and saturation magnetization of 66.3 emu/g, 5 pbw carbon black (Kethchen Black; made by Lion Yushi K.K.), and 1.5 pbw silica (#200; made by Nippon Aerosil K.K.), to obtain carrier E having a volume-average particle size of about 25 μm.

Production of Carrier F

Carrier F was produced in the same manner as carrier A with the exception that the materials below were used in the stated ratios, which included 100 pbw polyester resin (Toughton NE-1110; made by Kao Co., Ltd.), 350 pbw magnetic powder having a residual magnetization of 15.8 emu/g and saturation magnetization of 66.1 emu/g, 2 pbw carbon black (Kethchen Black EC; made by Lion Yushi K.K.), and 1.5 pbw silica (#200; made by Nippon Aerosil K.K.), to obtain carrier F having a volume-average particle size of about 60 μm.

Production of Carrier G

Carrier G was produced in the same manner as carrier A with the exception that the materials below were used in the stated ratios, and included 100 pbw polyester resin (Toughton NE-1110; made by Kao Co., Ltd.), 250 pbw magnetic powder having a residual magnetization of 15.8 emu/g and saturation magnetization of 66.1 emu/g, and 1.5 pbw silica (#200; made by Nippon Aerosil K.K.), to obtain carrier G having a volume-average particle size of about 28 μm.

The residual magnetization and saturation magnetization of each of the aforementioned types of magnetic powders were values within a magnetic field of 1 oersted measured using a direct current magnetization auto recorder (type 3257). The volume-average particle size of each carrier A through G was determined by measuring the particle relative volume distribution via an aperture tube of 280 μm using a Coulter Multisizer (made by Coulter Co.).

Measurement of Carrier Physical Properties

The residual magnetization, saturation magnetization, true specific gravity, aerated apparent specific gravity, the aforementioned $X^2/o^2$ value, volume intrinsic resistivity, dynamic current value, and volume-average particle size of each carrier A through G are shown in Table 1 below.

Figure 2:
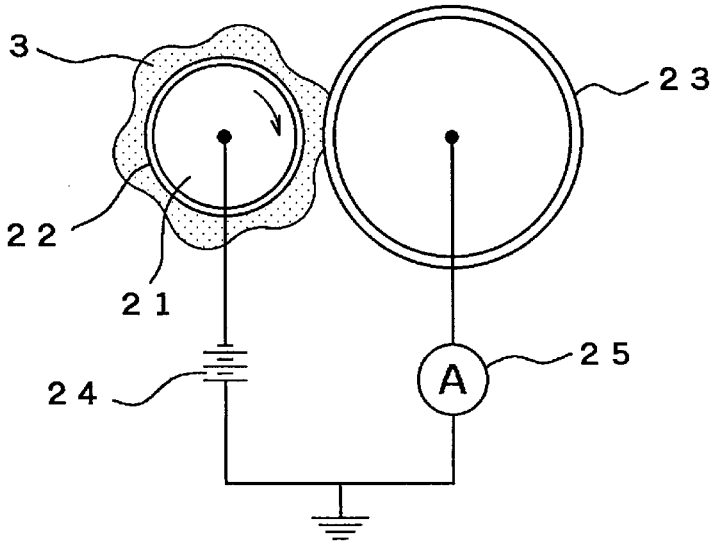
FIG. 2 briefly illustrates the method of measuring the dynamic current value in the carrier.

Residual magnetization and saturation magnetization were measured using the same direct current magnetization auto recorder (type 3257) used for the magnetic powder measurements. True specific gravity was measured using a model DM-1000 Pycnometer (made by Estech Co.). Apparent specific gravity was measured using a Powder Tester (made by Hosokawa Micron Co., Ltd.). Volume intrinsic resistivity was determined by placing 1 mm in thickness and 50 mm in diameter on a cylindrical metal electrode, and using an electrode having a mass of 1 kg and diameter of 20 mm, and guard electrode having an internal diameter of 38 mm and external diameter of 42 mm, applying a DC voltage of 500 V and reading the resistance value after 1 min, then calculating the volume intrinsic resistivity of each carrier. Dynamic current value was measured by supplying 5 g of carrier onto the surface of developing sleeve 22 having a magnetic flux density of 1000 Gauss via the built-in magnet roller 21, as shown in FIG. 2, and setting the spacing between sleeve roller 22 and electrode tube 23 at 1 mm, rotating the magnet roller 21 at 50 rpm, applying a DC voltage of 500 V from DC power unit 24, and measuring the current flowing through carrier 3 to electrode tube 23 using an ammeter, and this measured value was used as the dynamic current value.

TABLE 1

| Carrier | A | B | C | D | E | F | G |
|---|---|---|---|---|---|---|---|
| Residual magnetization (emu/g) | 4.1 | 6.9 | 3.0 | 12.1 | 15.1 | 12.3 | 11.9 |
| Saturation magnetization (emu/g) | 48.6 | 54.3 | 58.0 | 48.0 | 58.5 | 51.4 | 47.2 |
| True specific gravity (g/cc) | 2.4 | 2.9 | 3.0 | 2.8 | 3.6 | 3.3 | 3.1 |
| Aerated apparent specific gravity (g/cc) | 0.91 | 1.02 | 1.14 | 0.99 | 1.45 | 1.32 | 0.95 |
| Volume-average partucle size (μm) | 32 | 29 | 31 | 30 | 25 | 50 | 28 |
| $x^2/s^2$ | 10.9 | 11.2 | 11.1 | 10.9 | 10.8 | 8.4 | 8.0 |
| Volume resistivity (Ω · om) | $7.2 \times 10^{12}$ | $4.7 \times 10^{12}$ | $6.9 \times 10^{11}$ | $7.8 \times 10^{12}$ | $5.3 \times 10^{8}$ | $8.1 \times 10^{11}$ | $7.9 \times 10^{14}$ |
| Dynamic current (nA) | 19 | 26 | 32 | 21 | 80 | 33 | 4 |

Prepared developers including the carriers A through G combined with the toner produced in the manner described below were used in the developing device 10 shown in FIG. 1 to form images.

Toner Production Method

Two types of polyester resins (1) and (2) prepared as described below were used as binder resins for the toner.

Polyester resin (1) was prepared using a 2 liter four-mouth flask to which a reflux condenser, moisture separator, nitrogen gas tube, thermometer, and mixing device were attached, and the flask was placed in a mantle heater. Introduced into this flask were 735 g polyoxypropylene(2.2)-2,2-bis(4-hydroxyphenyl)propane as an alcohol component, 292.5 g polyoxyethylene(2.0)-2,2-bis(4-hydroxyphenyl)propane, 448.2 g terephthalic acid as a bivalent carboxylic acid component, and 22 g trimellitic acid as a trivalent carboxylic acid component. The material was mixed as nitrogen gas was introduced into the flask, a reaction conducted at 220° C. The acid value was measured during the continuing reaction, and the reaction was stopped when a predetermined acid value was attained, to obtain polyester resin (1) having a softening point of 105.1° C.

Polyester resin (2) was prepared in the same manner as polyester resin (1) with the exception that into the four-mouth flask were introduced 735 g polyoxypropylene (2.2)-2,2-bis(4-hydroxyphenyl)propane as an alcohol component, 292.5 g polyoxyethylene(2.0)-2,2-bis(4-hydroxyphenyl)propane, 249 g terephthalic acid as a bivalent carboxylic acid component, 177 g succinic acid, and 22 g trimellitic acid as a trivalent carboxylic acid component to obtain polyester resin (2) having a softening point of 150.1° C.

A mixture of 65 pbw of polyester resin (1), 35 pbw polyester resin (2), 3 pbw oxidized type polypropylene (Biscol TS-200; made by Sanyo Kasei Kogyo K.K.), 5 pbw negative charge control agent (Bontron S-34; made by Orient Chemical Industries Co., Ltd.), and 8 pbw carbon black (Mogul L; made by Cabot Co.) was thoroughly mixed, then subjected to fusion kneading in a vent type dual-shaft extrusion kneader at 140° C., cooled, and the kneaded mixture was coarsely pulverized using a feather mill, finely pulverized using a jet mill, then classified by forced air to obtain fine black particles having a volume-average particle size of 9 μm. To 100 pbw of this fine black powder was added 0.3 pbw hydrophobic silica (H-2000; made by Wakker Co.), and the mixture was processed for 1 min at 1,000 rpm in a Henchel mixer (made by Mitsui Miike Kakoki K.K.) to obtain negative chargeable toner.

Evaluations

Nine types of developer were prepared by combining the carriers A through G with the aforementioned toner in the combinations shown in Table 2 and designated Examples 1 through 9. These developers were then in developing device 10. The toner content of each developer is shown in the table.

In examples 1 through 9, the spacing between developing sleeve 11 and magnetic blade 13 in developing device 10 was adjusted to allow 5.0 mg/cm$^2$ of developer 1 to be transported to the developing region by developing sleeve 11, the circumferential speed of photosensitive member 2 was adjusted to 165 mm/s, the circumferential speed of developing sleeve 11 was adjusted to 300 mm/s, the surface potential of the area of photosensitive member 2 receiving the toner was −450 V, and the surface potential of the area on photosensitive member 2 not receiving toner was −100 V.

A developing bias voltage including an DC voltage of −350 V overlaid on an AC voltage having a square wave frequency of 3 kHz and duty ratio (developing: collection) of 1:1 was applied to the developing region wherein developing sleeve 11 confronts photosensitive member 2 to accomplish reversal development. The oscillating electric field ($V_{p\text{-}p}$/Ds) induced between developing sleeve 11 and photosensitive member 2 in the developing region was adjusted as shown in Table 2.

Images produced under the aforementioned developing conditions were evaluated for image density, fog, carrier adhesion, and density irregularity. Evaluation results are shown in Table 2.

Image density was rated as follows: adequate image density is expressed by O, slightly low image density is expressed by Δ, and very low image density impractical for use is expressed by X. Toner fog was rated by visual inspection of the white areas of the images; fog producing no practical problem was expressed by O, and fog producing noticeable image noise was expressed by X. Carrier adhesion was visually evaluated for carrier development on the non-image area of the image; no carrier adhesion was expressed by O, carrier adhesion posing no problem for practical use was expressed by Δ, and carrier adhesion causing noticeable image noise was expressed by X. Density irregularity was visually evaluated; no density irregularity was expressed by O, density irregularity which posed no problem for practical use was expressed by Δ, and severe density irregularity was expressed by X.

TABLE 2

| Example | 1 | 2 | 3 | 4 | 5 | 6 | 7 | 8 | 9 |
|---|---|---|---|---|---|---|---|---|---|
| Carrier type | A | B | C | D | E | F | G | H | I |
| Toner content (wt %) | 15 | 15 | 15 | 15 | 15 | 15 | 15 | 5 | 15 |
| Vp-p/Ds (kV/mm) | 4 | 4 | 4 | 4 | 4 | 4 | 4 | 4 | 2 |
| Image density | ○ | ○ | ○ | ○ | ○ | ○ | X | X | X |
| Fog | ○ | ○ | ○ | X | Δ | Δ | Δ | ○ | ○ |
| Carrier adhesion | ○ | ○ | ○ | ○ | X | Δ | Δ | ○ | ○ |

In examples 1 through 3 using carriers A through C having a residual magnetization of 10 emu/g or less and volume-average particle size in the range of 10 to 50 μm, there was no fog, density irregularity or carrier adhesion in the formed images, and excellent images were obtained which had suitable image densities.

On the other hand, n the examples 4 through 9 using carriers D through G which had large residual magnetization values above 10 emu/g, images with suitable image density were not obtained, and fog and density irregularities appeared in the formed images.

Although the present invention has been fully described by way of examples, it is to be noted that various changes and modification will be apparent to those skilled in the art.

Therefore, unless otherwise such changes and modifications depart from the scope of the present invention, they should be construed as bing included therein.

What is claimed is:

1. A developing method for developing electrostatic latent images comprising:

(a) forming a thin layer of a developer comprising a toner and a carrier on a developer transporting member having a magnet therein by contacting the developer with a developer regulating member, wherein said carrier has a volume-average particle size of 10 to 50 μm and a residual magnetization of 10 emu/g or less, wherein an amount of said thin layer of developer is in a range of 0.7 to 10.0 mg/cm$^2$, and wherein an amount of toner in the developer is in a range of 8 to 20 percent by weight;

(b) transporting the thin layer of developer to a developing region in which the developer transporting member confronts an image bearing member; and (c) supplying the toner contained in the developer from the developer transporting member to the image bearing member with applying an oscillated electric field on the developing region.

2. The developing method as claimed in claim 1 wherein an amount of the developer forming the thin layer is in a range of 0.8 to 7.5 mg/cm$^2$.

3. The developing method as claimed in claim 1 wherein space (Ds) between said developer transporting member and said image bearing member and peak to peak value of AC current voltage ($V_{p-p}$) applied on the developer transporting member satisfy the following relationship:

$$3.5\ (\text{kV/mm}) \leqq V_{p-p}/Ds \leqq 5.5\ (\text{kV/mm}).$$

4. The developing method as claimed in claim 1 wherein said developer regulating member comprises a magnetic blade.

5. The developing method as claimed in claim 1 wherein said carrier has a saturation magnetization of 30 to 80 emu/g.

6. The developing method as claimed in claim 5 wherein a volume-average particle size of the carrier designated as X (μm) and a variance of particle size distribution of the carrier designated as $o^2$ satisfy the following relationship:

$$X^2/o^2 \geqq 9.0.$$

7. The developing method as claimed in claim 6 wherein said toner has a volume average particle size of 4 to 9 μm, and the volume-average particle size of the carrier and the variance of particle size distribution of the carrier satisfy the following relationship:

$$X^2/o^2 \geqq 10.0.$$

8. The developing method as claimed in claim 1 wherein said carrier has a residual magnetization of 3 to 8 emu/g, a saturation magnetization of 35 to 65 emu/g, and a volume average particle size of 20 to 45 μm.

9. A developing method for developing electrostatic latent images comprising:

(a) forming a thin layer of a developer comprising a toner and a carrier on a developer transporting member having a magnet roller fixed therein by contacting the developer with a developer regulating member, wherein said toner has a volume-average particle size of 4 to 9 μm, and said carrier has a volume-average particle size of 10 to 50 μm, a residual magnetization of 10 emu/g or less, and a saturation magnetization of 30 to 80 emu/g, and wherein an amount of said thin layer of developer is in a range of 0.7 to 10.0 mg/cm$^2$;

(b) transporting the thin layer of developer to a developing region wherein said developer transporting member confronts an image bearing member; and (c) supplying the toner contained in the developer from the developer transporting member to the image bearing member with applying an oscillated electric field on the developing region.

10. The developing method as claimed in claim 9 wherein an amount of said thin layer of developer is in a range of 0.8 to 7.5 mg/cm$^2$ and an amount of said toner in the developer is in a range of 8 to 20 percent by weight.

11. The developing method as claimed in claim 10 wherein an amount of said thin layer of developer is in a range of 1 to 5 mg/cm$^2$.

12. The developing method as claimed in claim 9 wherein space (Ds) between said developer transporting member and said image bearing member and peak to peak value of AC current voltage ($V_{p-p}$) applied on the developer transporting member satisfy the following relationship:

$$3.5\ (\text{kV/mm}) \leqq V_{p-p}/Ds \leqq 5.5\ (\text{kV/mm}).$$

13. The developing method as claimed in claim 9 wherein said carrier has a residual magnetization of 3 to 8 emu/g, a saturation magnetization of 35 to 65 emu/g, and a volume average particle size of 20 to 45 μm.

14. The developing method as claimed in claim 13 wherein said carrier has a saturation magnetization of 40 to 60 emu/g, and a volume average particle size of 20 to 45 μm.

15. The developing method as claimed in claim 13 wherein a volume-average particle size of the carrier designated X (μm) and a variance of particle size distribution of the carrier $o^2$ satisfy the following relationship:

$X^2/o^2 \geqq 10.0$.

16. The developing method as claimed in claim 9 wherein said magnetic carrier comprises a binder resin and magnetic powder dispersed therein, said magnetic powder having a residual magnetization of 15 emu/g or less, and an amount of said magnetic powder being in a range of 150 to 500 parts by weight relative to 100 parts by weight of the binder resin.

17. The developing method as claimed in claim 16 wherein said magnetic powder has a residual magnetization of 10 emu/g or less and a saturation magnetization of 30 to 100 emu/g, and the amount of said magnetic powder is in a range of 250 to 400 parts by weight relative to 100 parts by weight of the binder resin.

18. The developing method as claimed in claim 16 wherein said carrier has a true specific gravity of 1.5 to 4.0 g/cc and an aerated apparent specific gravity of 0.5 to 2.0 g/cc.

19. The developing method as claimed in claim 16 wherein said carrier has an intrinsic resistance of $1\times10^9$ to $1\times10^{15}$ Ω·cm and dynamic current of 5 to 50 nA.

20. The developing method as claimed in claim 9 wherein said carrier has a true specific gravity of 2.0 to 3.5 g/cc, and an aerated apparent specific gravity of 0.8 to 1.3 g/cc, and an intrinsic resistance of $1\times10^{10}$ to $1\times10^{14}$ Ω·cm and dynamic current of 15 to 45 nA.

* * * * *